US006675516B1

(12) United States Patent
Slusher

(10) Patent No.: US 6,675,516 B1
(45) Date of Patent: Jan. 13, 2004

(54) DISPLAY DEVICE FOR VEHICLE

(75) Inventor: Mike Slusher, 2911 Brookshire Dr., Grapevine, TX (US) 76051

(73) Assignee: Mike Slusher

( * ) Notice: Subject to any disclaimer, the term of this patent is extended or adjusted under 35 U.S.C. 154(b) by 0 days.

(21) Appl. No.: 10/365,274

(22) Filed: Feb. 12, 2003

Related U.S. Application Data

(60) Provisional application No. 60/357,285, filed on Feb. 15, 2002.

(51) Int. Cl.[7] ..... G09F 21/04

(52) U.S. Cl. ..... 40/590; 587/594; 587/630; 587/672

(58) Field of Search ..... 40/590, 587, 594, 40/625, 628, 630, 672

(56) References Cited

U.S. PATENT DOCUMENTS 1,182,753 A * 5/1916 Clencie ..... 40/587
3,820,852 A * 6/1974 Kennedy ..... 40/587
3,887,268 A * 6/1975 Golden et al. ..... 40/613
5,246,517 A * 9/1993 Watson ..... 40/594
5,349,470 A * 9/1994 Alexander ..... 40/587
5,619,815 A * 4/1997 Greene ..... 40/587

* cited by examiner

*Primary Examiner*—Gary Hoge
(74) *Attorney, Agent, or Firm*—Buskop Law Group, P.C.; Wendy Buskop

(57) ABSTRACT

The invention is a display device for a vehicle with wheels having a first spoke and a second spoke made of a rigid display area with a first side and a second side and a thickness of 1/32$^{th}$ inch, a first attachment end for folding over the first spoke, a second attachment end for folding over the second spoke, a first adhesive strip and a second adhesive strip disposed on the first side and on the first attachment end, and a third adhesive strip and a fourth adhesive strip disposed the first side and on the second attachment end, wherein the first adhesive strip is proximate to the second adhesive strip and secures to the second adhesive strip and the third adhesive strip is proximate to the fourth adhesive strip and secures to the fourth adhesive strip.

4 Claims, 5 Drawing Sheets

DISPLAY DEVICE FOR VEHICLE

The present application claims priority to patent application Ser. No. 60/357,258 filed in the U.S. Patent and Trademark Office on Feb. 15, 2002, now abandoned.

FIELD OF THE INVENTION

This invention generally relates to a display device that can be easily installed around the spokes of a bicycle wheel or any wheel having spokes.

More specifically, the present invention relates to a display device that can contain lettering, advertising or other personal information between spokes.

BACKGROUND OF THE INVENTION

A need has long existed for a display device for vehicle to help customize a vehicle to the taste of the individual. The present invention meets this need.

Bicycling is becoming an increasingly more popular form of recreation as well as a means of transportation. Moreover, bicycling has become a very popular competitive sport for both amateurs and professionals. Whether the bicycle is used for recreation, transportation or competition, the bicycle industry is constantly improving the various components of the bicycle. This has resulted in many different types of bicycle wheels with different sizes and spoke orientations, different numbers of spokes, shapes of the spokes and other things. Racers use fewer spokes in order to decrease wind resistance. Small children typically have bicycles with more spokes.

A relatively conventional wheel has thirty-six spokes, with adjacent spokes intersecting each other at approximately 27.degrees. Such spokes are typically approximately two millimeters in diameter. More recently, bicycle wheels have been designed with fewer spokes to improve the performance of the bicycle wheel. For example, bicycle wheels have been developed with sixteen spokes. A bicycle wheel with sixteen spokes typically has its spokes intersecting at approximately 54 degrees.

One problem common among racing bicyclists is the lack of space on the bicycle to advertise or promote the products of their sponsors. Typically, these racing cyclists have had to put insignia and logos on their clothes to promote their sponsors. A need has long existed for a display device which can be used by racing cyclists, and other vehicles, which is durable and capable of providing information when the wheel is not rotating. A need has long existed for a device which is adaptable to different wheel sizes, to different spoke configurations, and can be used without harming the wind resistance of the device.

Early forms of these types of display devices had various mechanical disadvantages, such as being made from paper, which was impossible to use on racing bicycles.

In view of the above, there exists a need for a display device which overcomes the above mentioned problems in the prior art. This invention addresses this need in the prior art as well as other needs, which will become apparent to those skilled in the art from this disclosure.

SUMMARY OF THE INVENTION

The invention relates to a display device for vehicle having at least one wheel having a first spoke and a second spoke, comprising: a rigid display area having a first side and a second side, a first attachment end for folding over the first spoke and a second attachment end for folding over the second spoke, and wherein said rigid display area has a thickness of $1/32^{th}$ inch; a first adhesive strip and a second adhesive strip disposed on the first side and on the first attachment end, and a third adhesive strip and a fourth adhesive strip disposed the first side and on the second attachment end, wherein the first adhesive strip is proximate to the second adhesive strip, and the third adhesive strip is proximate to the fourth adhesive strip and the first adhesive strip secures to said second adhesive strip, and said third adhesive strip secures to said fourth adhesive strip.

The invention also relates to a display device for vehicle having at least one wheel having a first spoke and a second spoke, comprising: a rigid display area having a first side and a second side, a first attachment end for attachment around the first spoke and a second attachment end for attachment around the first spoke, and wherein said rigid display area has a thickness of $1/32^{th}$ inch; a first adhesive strip and a second adhesive strip disposed on the second side and on the first attachment end, and a third adhesive strip and a fourth adhesive strip disposed the second side and on the second attachment end, wherein the first adhesive strip is proximate to the second adhesive strip, and the third adhesive strip is proximate to the fourth adhesive strip; a fold formed in said rigid display area, wherein said rigid display area wraps around the second spoke, in the direction of wheel rotation, and said first adhesive strip adheres to said fourth adhesive strip, and said second adhesive strip adheres to said third adhesive strip and said second spoke nestles within said fold and said first spoke is disposed between the adhered first and fourth adhesive strips and the adhered second and third adhesive strips.

The invention also relates to a display device for vehicle having at least one wheel having a first spoke and a second spoke, comprising: a rigid display area having a first side a first attachment end and a second attachment end for attachment around second spoke, and wherein said rigid display area has a thickness of $1/32^{th}$ inch; a fold formed in said rigid display area, wherein said rigid display area wraps around the second spoke, and is oriented in the direction of wheel rotation a first adhesive strip and a second adhesive strip disposed on the first side and on the first attachment end, and a third adhesive strip and a fourth adhesive strip disposed on the first side proximate to each other and to the fold; the first attachment end of the rigid display area folds around second spoke over the first spoke and secures to the first and second adhesive strips and said third and fourth adhesive strips such that said second spoke nestles within said fold.

Finally, the invention relates to a display device for a vehicle having at least one wheel, wherein said wheel has a first spoke and a second spoke, comprising: a rigid display support having a first support end and a second support end, a first support side, a second support side, and wherein said rigid display support has a thickness of 1/32th inch. A first adhesive strip and a second adhesive strip are disposed on the first support side and on the first support end, and a third adhesive strip and a fourth adhesive strip are disposed on the first support side and on the second support end; a rigid display top attaches to said rigid display support, forming a laminate, and wherein said first spoke is disposed between said first and second adhesive strips and between said rigid display top and said rigid display support, and said second spoke is disposed between said third and fourth adhesive strips between said rigid display top and said rigid display support.

The invention particularly relates to a device for use with a bicycle.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

A specific embodiment of the invention will be described by way of example with reference to the accompanying drawings, in which.

DETAILED DESCRIPTION OF THE PREFERRED EMBODIMENTS

Before explaining the present invention in detail, it is to be understood that the invention is not limited to the particular embodiments and that it can be practiced or carried out in various ways.

Figure 1:
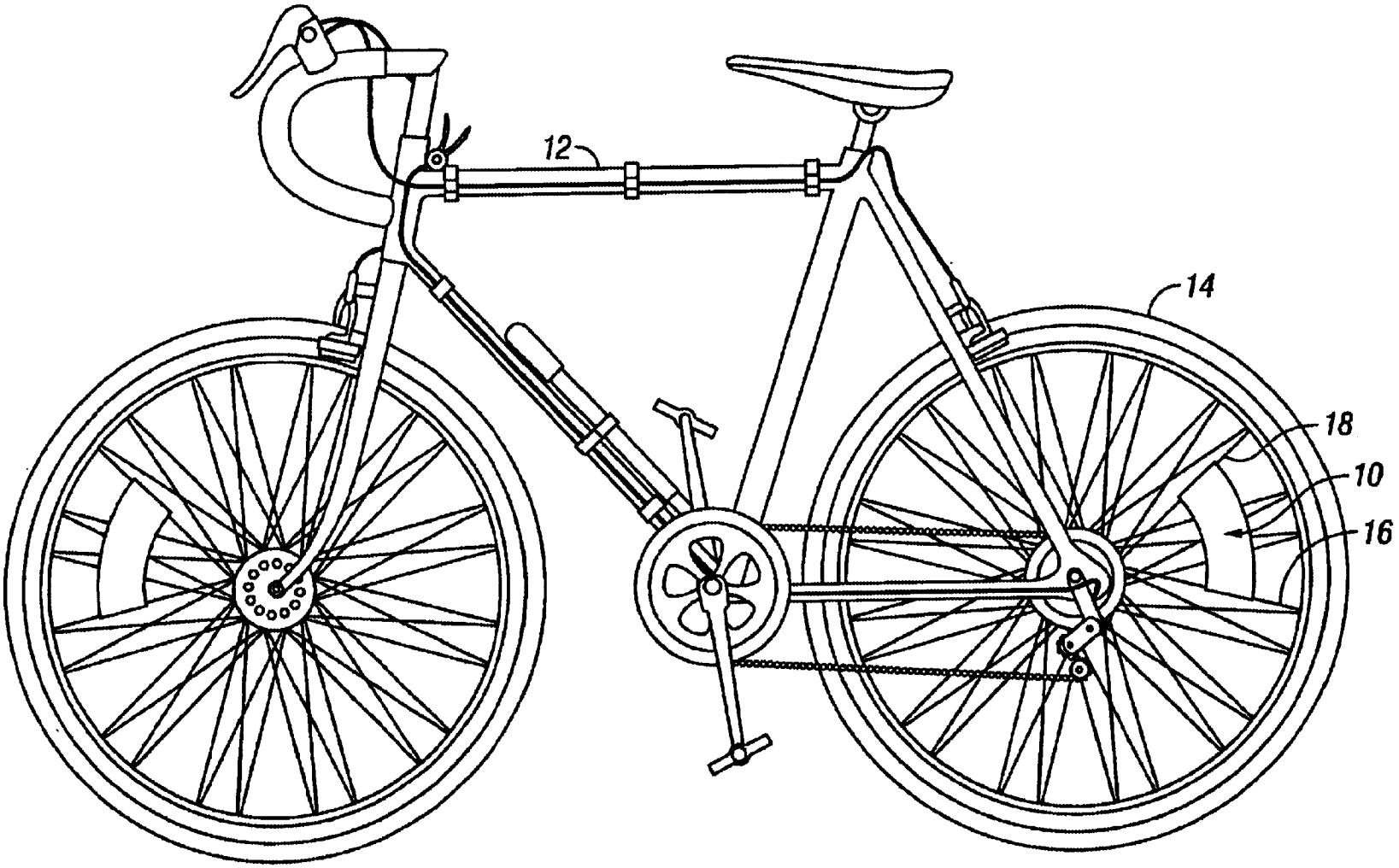
FIG. 1 is a bicycle with the invention attached.

Referring to FIG. 1, the present invention is a display device 10 for a vehicle 12, having at least one wheel 14, having a first spoke 16, and a second spoke 18. The vehicle 12 in the most preferred embodiment is a bicycle, such as a racing bicycle, but can also be children's bicycles or other vehicles as will be described herein.

Figure 2:
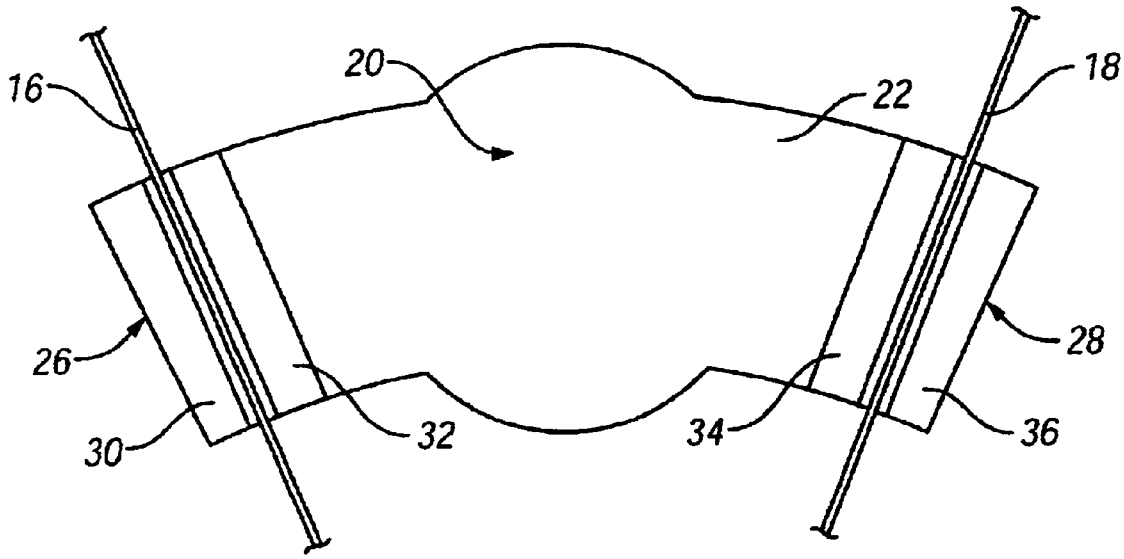
FIG. 2 is a top view of the invention.
Figure 3:
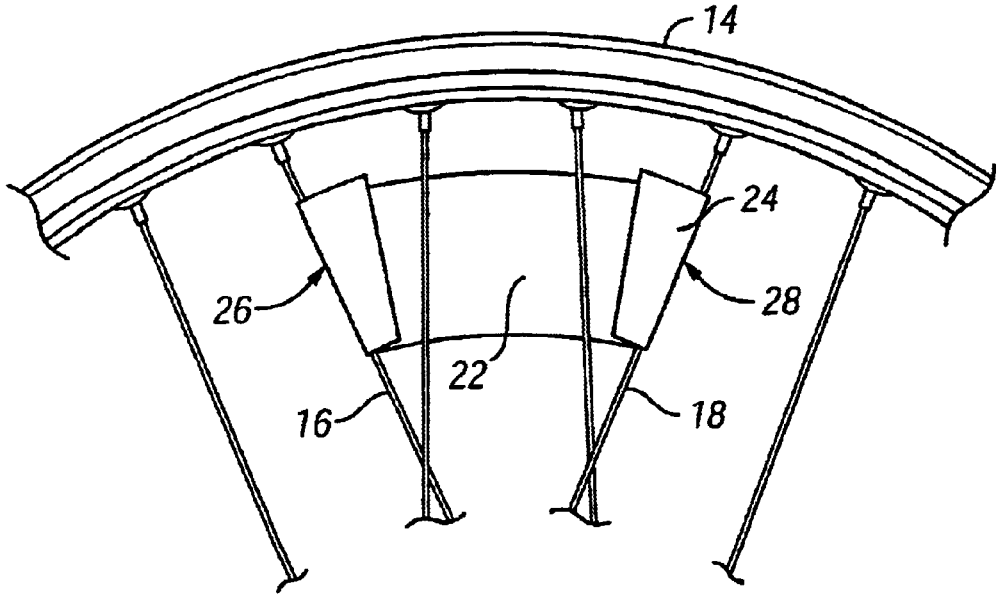
FIG. 3 shows a perspective view of the folded invention.

FIG. 2 shows the invention has a rigid display area 20 with a first side 22 and a second side 24, as shown in FIG. 3. Returning to FIG. 2, a first attachment end 26 for folding over the first spoke 16, and a second attachment end 28 for folding over the second spoke 18. The rigid display area 20 preferably has a thickness of $1/32^{th}$ inch.

FIG. 2 also shows a first adhesive strip 30 and a second adhesive strip 32 disposed on the first side 22 and on the first attachment end 26. A third adhesive strip 34 and a fourth adhesive strip 36 are disposed on the first side 22 and on the second attachment end 28. The first adhesive strip 30 is proximate to the second adhesive strip 32. The third adhesive strip 34 is proximate to the fourth adhesive strip 36. In this embodiment, the first adhesive strip 30 secures to the second adhesive strip 32, around spoke 16 and the third adhesive strip 34 secures to the fourth adhesive strip 36, around spoke 18.

The vehicle on which the invention can be used can be a bicycle, tricycle, unicycle, baby carriage, trailer, motorcycle, scooter, shopping cart, or wagon.

The display device most preferably has a length between 4 inches and 13 inches, and a width of between 3.5 inches and 5 inches.

For wheels that range in diameter from 26 to 27 inches the display device can have a 12.57 inch length and a width of 3.5 inches.

For wheels that have a diameter of 24 inches, the display device has an 11 inch length and a width of 3 inches.

For wheels that range in diameter from 16 to 20 inches the display device has an 8 inch length and a width of 2.5 inches.

In a preferred embodiment shown in FIG. 2, the rigid display area 20 is circular, however the rigid display area can be crescent shaped and have between a 30 and 90 degree arc.

In another preferred embodiment, the rigid display area has a 60 degree arc.

The rigid display area 20 can be sheet plastic and utilize adhesive that has a holding power of at least 1 lb per square inch, and withstand shear up to 60 pounds per square inch.

Preferably, the rigid display area 20 is made from polypropylene, Mylar, or an acrylic.

The adhesive of adhesive 30, 32, 34, and 36 can be a two sided adhesive tape capable of supporting at least 1 pound per square inch.

The display device can have pigment disposed on the surface of the first side 22, or only on top of the rigid display area 20.

Preferably, the pigment can be in the form of lettering or logos. The pigment can be a phosphorescent, fluorescent, luminescent, or opaque pigment. The pigment can be embedded in the sheet plastic, however, additional pigment can be disposed on the sheet plastic or rigid display area 20.

In another embodiment, the adhesive strips can be square patches.

FIG. 3 shows the invention preferably has a first side 22 and a second side 24, a first attachment end 26 for attachment around the first spoke 16 and a second attachment end 28 for attachment around the second spoke 18 of wheel 14.

Figure 4:
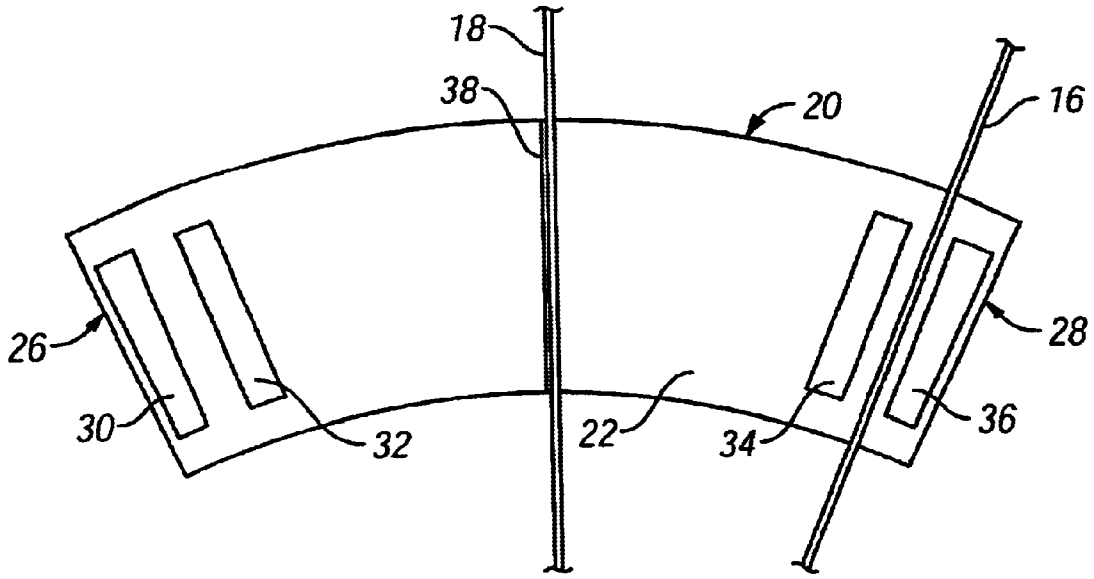
FIG. 4 shows another view of the invention.

FIG. 4 provides a detail of the invention that shows a first adhesive strip 30 and a second adhesive strip 32 that is disposed on the first side 22 and on the first attachment end 26. A third adhesive strip 34 and a fourth adhesive strip 36 are disposed on the first side 22 is proximate to each other on the second attachment end 28.

The first attachment end 26 of the rigid display area 20 folds around second spoke 18 over the first spoke 16 and secures 34 and 36 to the first and second adhesive strips 30 and 32 to the third and fourth adhesive strips 34 and 36 such that the second spoke 18 nestles within the fold 38.

Figure 5:
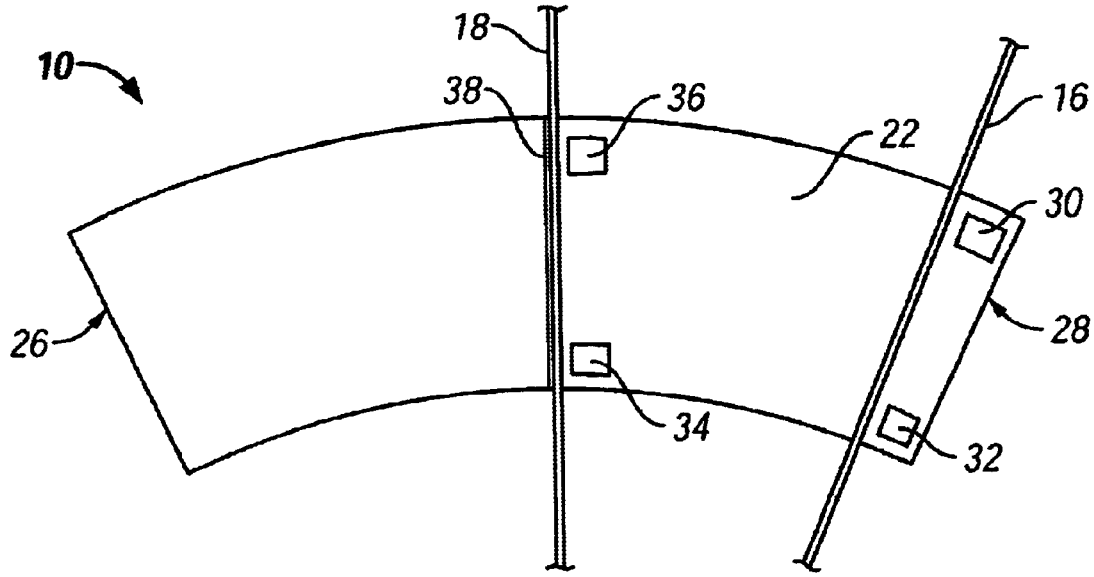
FIG. 5 shows another view of the invention.

Referring to FIG. 5, which provides another embodiment of the rigid display device 10. The rigid display area wraps around the second spoke 18 in the direction of wheel rotation. The first attachment end 26 wraps over spoke 18 forming fold 38 and securing to the first adhesive 30, the fourth adhesive strip 36, the second adhesive strip 32, and the third adhesive strip 34. The first spoke 16 is disposed between the first adhesive strip 30 and fourth adhesive strip 36 and between the second adhesive strip 32 and third adhesive strip 34. The adhesive strips in this embodiment are square.

Figure 6:
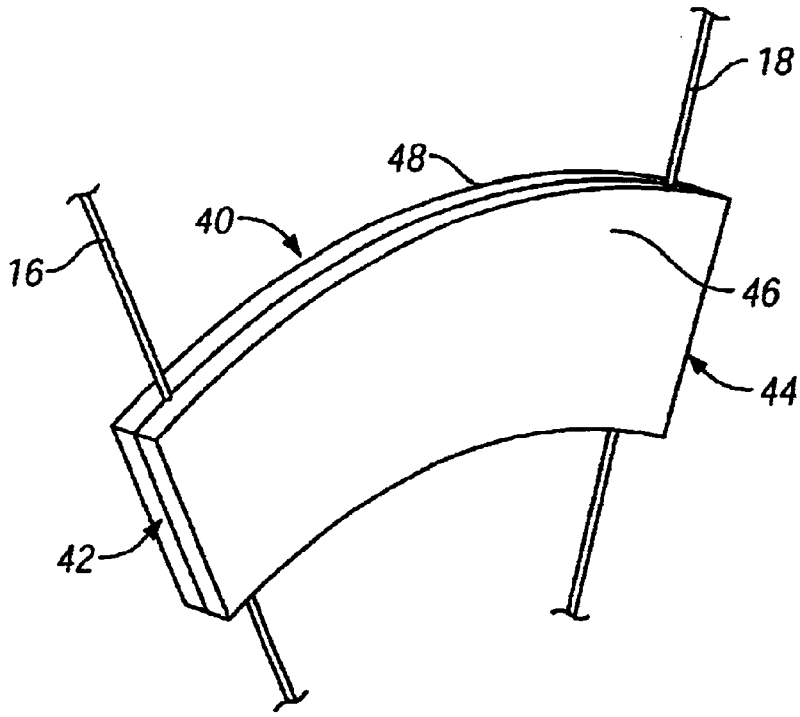
FIG. 6 shows a perspective view of the invention attached to two spokes.

As shown in FIG. 6, a rigid display support 40 preferably has a first support end 42, a second support end 44, a first support side 46, and a second support side 48. Spokes 16 and 18 are contained within the rigid display support 40.

Figure 7:
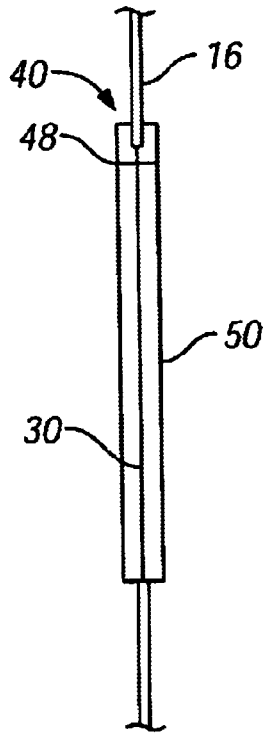
FIG. 7 shows the end view of the invention.
Figure 8:
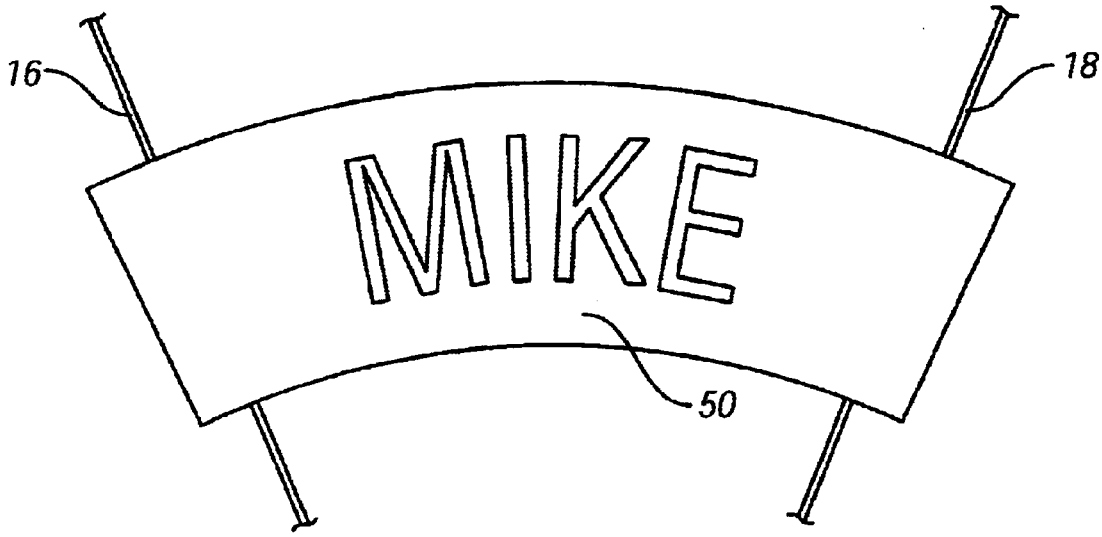
FIG. 8 shows the front view of the invention.
Figure 9:
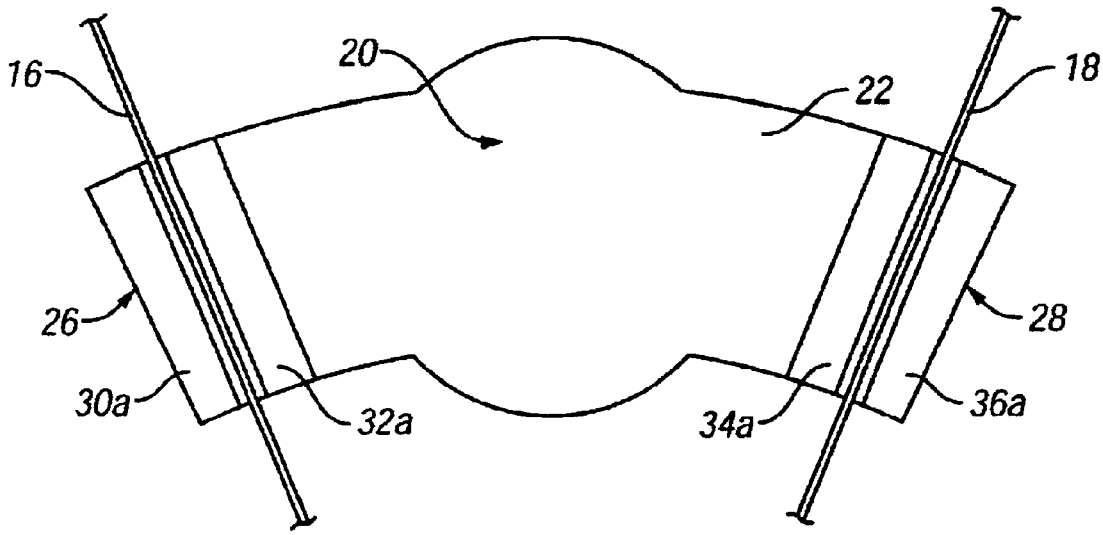
FIG. 9 depicts the invention having a rigid display support.

FIGS. 7 and 8 show an embodiment similar to that of FIG. 6, wherein a rigid display support **40*a* has a rigid display top 50, which attaches to the rigid display support 40*a*, forming a laminate. Preferably, the first spoke 16 is disposed between first adhesive strip 30*a* and second adhesive strip 32*a* (shown in phantom in FIG. 8), and between the rigid display top 50, and a second support 48*a*. The second spoke 18 is disposed between third adhesive strip 34*a* and fourth adhesive strip 36*a*, and between the rigid display top 50 and the rigid display support 40*a***.

FIG. 8 shows the rigid display top 50 being painted with the name "Mike" and supported between spokes 16 and 18.

What is claimed is:

1. A display device for a vehicle having at least one wheel having a first spoke and a second spoke, comprising:

a. a rigid display area comprising
   i. a first side;
   ii. a second side;
   iii. a first attachment end for folding over the first spoke;
   iv. a second attachment end for folding over the second spoke; and
   v. wherein said rigid display area has a thickness of $1/32^{th}$ inch;

b. a first two-sided adhesive strip and a two-sided second adhesive strip disposed on the first side and on the first attachment end, wherein the first two-sided adhesive strip is proximate to the second two-sided adhesive strip;

c. a third two-sided adhesive strip and a fourth two-sided adhesive strip disposed the first side and on the second attachment end, wherein third two-sided adhesive strip is proximate to the fourth two-sided adhesive strip;

d. wherein the first two-sided adhesive strip secures to said second two-sided adhesive strip and said third two-sided adhesive strip secures to said fourth two-sided adhesive strip; and e. wherein each two-sided adhesive tape is capable of supporting at least 1 pound per square inch.

2. A display device for vehicle having at least one wheel having a first spoke and a second spoke, comprising:

a. a rigid display area comprising
   i. a first side;
   ii. a second side;
   iii. a first attachment end for attachment around the first spoke;
   iv. a second attachment end for attachment around the first spoke; and
   v. wherein said rigid display area has a thickness of $1/32^{th}$ inch;

b. a first two-sided adhesive strip and a second two-sided adhesive strip disposed on the second side and on the first attachment end;

c. a third two-sided adhesive strip and a fourth two-sided adhesive strip disposed the second side and on the second attachment end;

d. wherein the first two-sided adhesive strip is proximate to the second two-sided adhesive strip and the third two-sided adhesive strip is proximate to the fourth two-sided adhesive strip;

e. a fold formed in said rigid display area;

f. wherein said rigid display area wraps around the second spoke, in the direction of wheel rotation, and said first two-sided adhesive strip adheres to said fourth two-sided adhesive strip, and said second two-sided adhesive strip adheres to said third two-sided adhesive strip and said second spoke nestles within said fold and said first spoke is disposed between the adhered first and fourth two-sided adhesive strips and the adhered second and third two-sided adhesive strips; and g. wherein each two-sided adhesive tape is capable of supporting at least 1 pound per square inch.

3. A display device for vehicle having at least one wheel having a first spoke and a second spoke, comprising:

a. a rigid display area comprising
   i. a first side;
   ii. a second side;
   iii. a first attachment end for attachment around the first spoke;
   iv. a second attachment end for attachment around the first spoke; and
   v. wherein said rigid display area has a thickness of $1/32^{th}$ inch;

b. a fold formed in said rigid display area, wherein said rigid display area wraps around the second spoke, and is oriented in the direction of wheel rotation;

c. a first two-sided adhesive strip and a second two-sided adhesive strip disposed on the first side and on the first attachment end;

d. a third two-sided adhesive strip and a fourth two-sided adhesive strip disposed on the first side proximate to each other and to the fold;

e. wherein the first attachment end of the rigid display area folds around second spoke over the first spoke and secures to the first and second two-sided adhesive strips and said third and fourth two-sided adhesive strips such that said second spoke nestles within said fold; and f. wherein each two-sided adhesive tape is capable of supporting at least 1 pound per square inch.

4. A display device for a vehicle having at least one wheel, wherein said wheel has a first spoke and a second spoke, comprising:

a. a rigid display support comprising
   i. a first support end;
   ii. a second support end;
   iii. a first support side;
   iv. a second support side; and
   v. wherein said rigid display support has a thickness of 1/32th inch;

b. a first two-sided adhesive strip and a second two-sided adhesive strip are disposed on the first support side and on the first support end;

c. a third two-sided adhesive strip and a fourth two-sided adhesive strip are disposed on the first support side and on the second support end;

d. a rigid display top attached to said rigid display support forming a laminate;

e. wherein said first spoke is disposed between said first and second two-sided adhesive strips and between said rigid display top and said rigid display support and said second spoke is disposed between said third and fourth two-sided adhesive strips between said rigid display top and said rigid display support; and f. wherein each two-sided adhesive tape is capable of supporting at least 1 pound per square inch.

* * * * *